US005320801A

United States Patent [19]

Culling

[11] Patent Number: 5,320,801

[45] Date of Patent: Jun. 14, 1994

[54] HIGH CARBON HIGH CHROMIUM ALLOYS HAVING CORROSION AND ABRASION RESISTANCE

[75] Inventor: John H. Culling, St. Louis, Mo.

[73] Assignee: Carondelet Foundry Company, Pevely, Mo.

[21] Appl. No.: 52,644

[22] Filed: Apr. 26, 1993

[51] Int. Cl.[5] ..... C22C 38/42; C22C 30/00

[52] U.S. Cl. ..... 420/49; 420/50; 420/582; 420/585

[58] Field of Search ..... 420/582, 585, 49, 50

[56] References Cited

U.S. PATENT DOCUMENTS

| | | | |
|---|---|---|---|
| 3,758,296 | 9/1973 | Johnson | 75/122 |
| 4,063,934 | 12/1977 | Thuillier et al. | 420/582 |
| 4,080,198 | 3/1978 | Heyer et al. | 75/125 |
| 4,536,232 | 8/1985 | Khandros et al. | 148/35 |

FOREIGN PATENT DOCUMENTS

| | | | |
|---|---|---|---|
| 4731205 | 8/1972 | Japan | 420/49 |
| 59-38365 | 3/1984 | Japan | 420/49 |
| 0143050 | 8/1984 | Japan | 420/49 |
| 805187 | 12/1958 | United Kingdom | 420/582 |
| 1440362 | 6/1976 | United Kingdom | 420/49 |

OTHER PUBLICATIONS

Niu Hong-jun et al., Heat-Resisting Materials, Proceedings of the First International Conference, Fontana, Wis., USA/Sep. 23-26, 1991, pp. 269-274.

*Primary Examiner*—Deborah Yee

*Attorney, Agent, or Firm*—Senniger, Powers, Leavitt & Roedel

[57] ABSTRACT

Air-meltable, castable, machinable, hardenable alloys that are resistant to highly corrosive and abrasive slurries, especially those employed in the handling of wet-process phosphoric acid reactor fluids or hot concentrated sulfuric acid. The alloys consist of, by weight, about 11% to about 40% nickel (plus cobalt), about 27% to about 42% chromium, about 1% to about 4% copper, about 3% to about 4.5% silicon, about 0.7% to about 2% carbon, about 0.3% to about 3% manganese, up to about 4.5% molybdenum, and the balance essentially iron plus the usual minor impurities.

12 Claims, No Drawings

HIGH CARBON HIGH CHROMIUM ALLOYS HAVING CORROSION AND ABRASION RESISTANCE

This invention relates to ferrous metal alloys which are superior to stainless steels and nickel-chromium alloys under conditions where both abrasion and corrosion of the metal may occur, especially in wet-process phosphoric acid plant reactors.

BACKGROUND OF THE INVENTION

Phosphoric acid, an important ingredient of chemical fertilizers, is produced from natural deposits of phosphate rock by the so-called wet-process, in which ground phosphate rock is reacted with sulfuric acid to produce phosphoric acid as a solution and gypsum as a precipitate.

The composition of the reactor slurry in phosphoric acid production processes varies somewhat but such slurries typically contain ground rock, about 33% phosphorous pentoxide (equivalent to about 45.55% phosphoric acid), 2 to 5% sulfuric acid, 1 to 3% fluosilicic acid, fluosilicates and small amounts of chlorides and hydrofluoric acid. The operating temperature is typically about 80° C.

Metallic equipment for handling phosphoric acid reactor slurry is subjected to scouring or abrasive action of the suspended solid particles as well as to chemical attack by the acid solution. Pump parts, elbows and other cast shapes are particularly susceptible to damage.

Stainless steels and nickel-chromium corrosion resistant alloys have been used for phosphoric acid reactor equipment. Such alloys have been hardened by cold working, phase transformation of the metallic matrix, precipitation of hard carbides, or precipitation of other hard phases including borides, silicides and sigma phase. Cold working and deformation, however, do not substantially enhance abrasion resistance. Moreover, cold working and deformation are not applicable to cast shapes. Alloys which are hardened with significant amounts of borides, silicides and sigma phase have generally been quite brittle due to the brittle nature of these phases.

Alloys previously formulated for service in abrasive, erosive or corrosive environments include Illium B, Illium P, Lewmet, HC250 and SPA, but these alloys have not provided satisfactory performance in phosphoric reactors and typically only provide a service life of about two to four months. There remains, therefore, a need for an improved alloy to handle both the corrosive and the abrasive actions of phosphoric acid slurries. Since phosphoric acid processes employ large quantities of sulfuric acid, it is desirable for the selected alloy to also be resistive to that acid.

SUMMARY OF THE INVENTION

Among the several objects of the present invention, therefore, may be noted the provision of alloys resistant to the corrosive and abrasive attack of hot wet-process phosphoric acid reactor slurries; the provision of such alloys that are also resistant to hot concentrated sulfuric acid solutions; the provision of such alloys that have an austenitic matrix and only moderate hardness and that may therefore be readily machined; the provision of such alloys that may be easily formulated from the readily available elements, iron, nickel, chromium, molybdenum, copper, carbon and the usual steelmaking deoxidizers; the provision of such alloys that may be easily melted and cast in air.

Briefly, therefore the present invention is directed to air-meltable, castable, machinable, hardenable alloys that are resistant to highly corrosive and abrasive slurries, especially those employed in the handling of wet-process phosphoric acid reactor fluids or hot concentrated sulfuric acid. The instant alloys consist of, by weight, about 11% to about 40% nickel (plus cobalt), about 27% to about 42% chromium, about 1% to about 4% copper, about 3% to about 4.5% silicon, about 0.7% to about 2% carbon, about 0.3% to about 3% manganese, up to about 4.5% molybdenum, and the balance essentially iron plus the usual minor impurities.

DETAILED DESCRIPTION OF THE INVENTION

In accordance with the invention, alloys are formulated which have hard carbides imbedded in a soft wholly austenitic matrix, that is, a matrix of face center cubic crystal structure, and provide excellent resistance to slurry abrasion and corrosion.

The primary components of the alloys of the invention are:

| | |
|---|---|
| CHROMIUM | 27 TO 42% BY WEIGHT |
| NICKEL (PLUS COBALT) | 11 TO 40% |
| SILICON | 3 TO 4.5% |
| COPPER | 1 TO 4% |
| CARBON | 0.7 TO 2% |
| MANGANESE | 0.3 TO 3% |
| MOLYBDENUM | UP TO 4.5% |
| IRON | ESSENTIALLY THE BALANCE. |

For most applications it has been found preferable to restrict the ranges of elements to the following ranges:

| | |
|---|---|
| CHROMIUM | 27 TO 34% BY WEIGHT |
| NICKEL (PLUS COBALT) | 13 TO 31% |
| SILICON | 3.2 TO 4.5% |
| COPPER | 2.5% TO 4% |
| CARBON | 0.7 TO 1.6% |
| MANGANESE | 0.5 TO 1.5% |
| MOLYBDENUM | 1 TO 4% |
| IRON | ESSENTIALLY THE BALANCE. |

The nickel content of the alloys of the invention is selected with respect to the other elements present and to anticipated heat treatment so that the alloys are always composed of carbides imbedded in a matrix of austenite. When the alloys are to be cast into thin sections, or cast into heavier sections and cooled from 2000° F., a minimum of about 11% nickel is sufficient to provide the austenitic matrix. For normal casting procedures a minimum of about 12% Ni will ordinarily be required to ensure an austenitic matrix. The nickel content is maintained below about 40% because it is a relatively expensive element and there is no need for higher nickel content to ensure the proper matrix in these alloys.

The alloys of the present invention are formulated so as to contain between about 0.7% and 2% C. This carbon level is selected in order to supply sufficient carbon for the formation of the quantity of carbides necessary to provide the desired resistance to attack in phosphoric acid slurries. For these alloys a lower carbon content within the range of 0.7% to 2% generally results in a shorter expected service life whereas a higher carbon content provides a longer expected service life. Alloys of higher carbon content within this range, e.g., 1.5% C or greater, however, are generally more brittle and less machinable than their lower carbon counterparts. It is therefore often necessary to accept a sacrifice in service life in order to attain the desired machinability. More particularly, an alloy of the invention having 0.7% C has an expected service life of about one fourth that of an alloy having 1.5% C. The expected service life of an alloy having 1% C is about one half that of an alloy having 1.5% C. However, in certain applications where ductility is desired, for example, where the alloy is to be machined into a complex shape, an alloy having about 0.7% to 1.0% C may be preferred over an alloy having 1.5% C despite the sacrifice in expected service life. Specifically, alloys of the invention having about 0.7% C to about 1% C typically would have about 2% to 5% tensile elongation, with about 4% to 8% elongation possible by heat treatment. It is reasonable to use the lower carbon alloys of the invention, and to accept less-than-optimum expected service life, because in typical acid slurries for which the present alloys are intended, they have an expected service life of up to several years and of the order of ten to twenty times that of prior art alloys.

The selected chromium content must be sufficient to provide chromium for two purposes, to combine with carbon to form carbides and to remain in the matrix for corrosion resistance. The combination of chromium with carbon accounts for an amount of chromium roughly on the order of 6 to 10 times the carbon content by weight. For these alloys containing between about 0.7% and about 2.0% C, I have found that a total chromium content of about 27% to 42% is required for sufficient chromium to remain in solid solution after casting and whatever aging or other heat treatments are to be performed to provide the corrosion and abrasion resistance required for the applications for which these alloys are intended.

Because chromium carbides account for a proportion of the total chromium content of the alloys of the invention, an alloy of a given total chromium level and relatively low carbon level will have a higher chromium content in its metallic matrix than will an alloy of the same total chromium level having a higher carbon level. Also, for any desired chromium level in the matrix, a lower carbon alloy requires less total chromium than a higher carbon alloy because a smaller portion of the total chromium exists as carbides. For example, an alloy of the invention having about 1% C and about 30% total Cr would consist of about 6 to 10% Cr in the carbides and about 20 to 24% Cr in solution in the metallic matrix. Furthermore, if the carbides constitute about 14% of the alloy, the matrix would constitute about 86% of the alloy.

It has been found that up to about 1% Co, up to about 1% Nb (Cb) and up to about 2% W may be present in the alloys of the invention without detriment to corrosion resistance. These elements may be present as a result of using scraps, turnings and similar materials in the formation of the alloys. However, greater than about 0.5% each of niobium or tungsten must be compensated for by some nickel increases in some instances. These two elements are therefore not intentionally added to alloys of the invention.

The molybdenum content of these alloys is up to about 4.5% and may be varied depending on the expected service conditions. For example, for applications involving solutions of 70% or less sulfuric acid or solutions of phosphoric acid, the alloys should contain at least about 2% Mo, preferably between about 2% and 4.5% Mo. For applications involving 95–98% sulfuric acid, the alloys may contain little or no molybdenum.

Silicon and manganese are commonly employed in steelmaking as deoxidizers. Additionally, up to about 4.5% Si may be employed for handling hot, concentrated sulfuric acid or hot, concentrated nitric acid. Up to about 3% Mn may be used without detriment to the instant alloys. Copper is employed in amounts between about 1% and 4% to enhance resistance to attack by sulfuric acid and certain other substances.

While the hardness of high carbon, high chromium austenitic alloys can be significantly increased by aging heat treatments, it now appears that in many slurries the as cast alloys of the invention are at least as resistant to corrosion and abrasion as are those in the age hardened condition. It has been discovered that, even though in certain instances it was previously thought best to increase the hardness of prior art alloys as much as practicably possible, increasing the hardness of the high carbon, high chromium alloys formulated according to this invention, contrary to what might be expected, does not necessarily provide improved abrasion resistance. Moreover, it is often desirable to have alloys available that have some ductility and tensile elongation so that they are conducive to machining into complex shapes. The hardness of the alloys of the invention, therefore, is preferably below about 380 BHN when they are to undergo significant amounts of machining.

The following examples further illustrate the invention:

EXAMPLE 1

Heats of several different alloys were prepared in accordance with the invention. Corrosion test blocks of each alloy measuring 2.5 inches long by 1.25 inches wide by 0.4 inch thick were cast in dry sand molds. The composition of these alloys is set forth in Table I with the balance in each case being essentially iron.

TABLE I

| | ALLOYS OF THE INVENTION | | | | | | | |
|---|---|---|---|---|---|---|---|---|
| | COMPOSITION BY WEIGHT PERCENTAGES | | | | | | | |
| ALLOY | Ni | Cr | Mo | Cu | Si | Mn | Cb | C |
| A | 25.1 | 32.1 | 2.20 | 1.13 | 3.51 | 1.02 | — | 1.19 |
| B | 16.3 | 29.1 | .42 | 2.06 | 3.10 | .99 | .41 | 1.62 |
| C | 36.9 | 34.3 | .43 | 3.42 | 3.89 | .75 | — | 1.20 |
| D | 38.2 | 39.8 | 1.52 | 2.11 | 3.29 | .59 | .29 | 1.39 |
| E | 27.1 | 29.9 | — | 2.59 | 4.32 | 2.82 | — | 1.08 |
| F | 25.2 | 32.2 | 3.03 | 1.98 | 3.49 | 1.13 | — | 1.02 |
| G | 26.6 | 33.2 | .33 | 3.53 | 3.02 | 2.95 | — | 1.22 |
| H | 22.8 | 32.6 | 2.50 | 2.88 | 3.52 | .43 | — | .93 |
| I | 23.9 | 31.9 | 3.73 | 3.36 | 3.56 | .28 | — | .84 |

Test blocks in the as cast condition were immersed in 600 ml beakers containing various solutions in such a manner that they were supported on one end by a bed of half-inch diameter glass marbles and on the other end by the side of the beaker so that all faces were in contact with the solutions. Each test block was weighed to the nearest 1,000th of a gram before and after the immersions and the weight loss was converted to a figure of average depth of corrosion penetration in mils per year (MPY) in accordance with the relationship:

$$MPY = 303.7 \frac{Wo - Wf}{ATD}$$

where

| | |
|---|---|
| Wo = | ORIGINAL WEIGHT OF SAMPLE |
| Wf = | FINAL WEIGHT OF SAMPLE |
| A = | AREA OF SAMPLE IN SQUARE CENTIMETERS |
| T = | DURATION OF THE TEST IN YEARS |
| D = | DENSITY OF THE ALLOY IN GRAMS PER CUBIC CENTIMETER. |

Samples from experimental heats A, D, F, H and I were tested in a solution of 46% phosphoric acid (33% phosphorus pentoxide), 3.5% sulfuric acid and 100 parts per million of chloride ion at 80° C. for a period of 24 hours. The weight loss in each case was 1.8 MPY or less.

These same five alloys were then tested for 24 hours at 90° C. in a solution of the same composition. The weight loss in each case was 2.6 MPY or less.

EXAMPLE 2

Samples of the experimental heats of Example 1 except the molybdenum-free alloy E were tested for 24 hours at 80° C., 90° C. and 100° C. each in 80%, 85%, 90%, 93% and 96% sulfuric acid water solutions. The results of these tests are set forth in Table II. Values over 10 MPY are rounded to the nearest MPY.

TABLE II

WEIGHT LOSS IN VARIOUS SULFURIC ACID-WATER SOLUTIONS AT 80° C., 90°, & 100° C., MPY

| ACID STRENGTH | TEMP. | A | B | C | D | F | G | H | I |
|---|---|---|---|---|---|---|---|---|---|
| 80% | 80° C. | 15 | 18 | 3.4 | 13 | 11 | 10 | 3.6 | 2.8 |
| | 90° C. | 26 | 27 | 5.6 | NT | NT | NT | 5.4 | 6.2 |
| | 100° C. | 42 | 42 | 10.2 | NT | NT | NT | 9.7 | 10.1 |
| 85% | 80° C. | 3.2 | 8.5 | 2.1 | 7.9 | 4.6 | 3.9 | 1.9 | 2.2 |
| | 90° C. | 3.8 | 12 | 3.5 | 11 | 7.2 | 6.2 | 3.4 | 2.9 |
| | 100° C. | 7.9 | 18 | 5.0 | 17 | 10 | 8.1 | 4.6 | 5.3 |
| 90% | 80° C. | 11 | 9 | 1.6 | 9.2 | 8.1 | 10 | 1.7 | 2.0 |
| | 90° C. | 15 | 13 | 3.1 | 12 | 12 | 14 | 2.8 | 3.3 |
| | 100° C. | 22 | 18 | 4.2 | 16 | 17 | 21 | 3.8 | 3.9 |
| 93% | 80° C. | 8.2 | 9.2 | 1.1 | 7.2 | 8.3 | 6.4 | 1.3 | 1.4 |
| | 90° C. | 9.3 | 13 | 2.1 | 10 | 12 | 10 | 1.9 | 2.4 |
| | 100° C. | 10 | 18 | 3.1 | 11 | 17 | 15 | 2.8 | 3.3 |
| 96% | 80° C. | 1.0 | 2.2 | 0.8 | 0.6 | 2.2 | 1.1 | 1.0 | 0.9 |
| | 90° C. | 1.1 | 3.3 | 1.7 | 0.8 | 4.1 | 3.8 | 1.8 | 1.9 |
| | 100° C. | 1.7 | 11 | 2.8 | 1.5 | 6.2 | 5.8 | 2.6 | 3.1 |

NT = NOT TESTED

If a maximum permissible loss of 20 MPY is assumed, which those working in the art accept as reasonable, it appears from Table II that for alloys of the invention to be used above 80° C. in sulfuric acid strengths below about 93%, the chromium index "CI", defined as the chromium content minus 6.08 times carbon content, should not be less than 25. For example, for sample A, which exhibited 26 MPY weight loss when tested at 90° C. in 80% sulfuric acid, the chromium index is less than 25:

$$\begin{aligned} CI &= [Cr] - 6.08[C] \\ &= 32.1 - 6.08(1.19) \\ &= 24.9. \end{aligned}$$

In contrast, for sample H, which exhibited only 5.4 MPY weight loss when tested at 90° C. in 80% sulfuric acid, the chromium index is not less than 25:

$$\begin{aligned} CI &= [Cr] - 6.08[C] \\ &= 32.6 - 6.08(0.93) \\ &= 26.9. \end{aligned}$$

The alloys of the invention of at least about 0.33% Mo and at least about 3.5% Si may be employed at least to 100° C. at all acid strengths of 80% or higher when this calculation is at least about 27. For example, for the test of sample C at 100° C. in 96% sulfuric acid, which exhibited only 2.8 MPY weight loss, the chromium index is at least about 27:

$$\begin{aligned} CI &= [Cr] - 6.08[C] \\ &= 34.3 - 6.08(1.20) \\ &= 27. \end{aligned}$$

EXAMPLE 3

In a manner similar to Examples 1 and 2 above, samples from heats C, D, E, F, G, H and I were tested for 24 hours in 95 to 98% strength sulfuric acid at temperatures from 80° C. to 200° C. The results from these tests are set forth in Table III.

TABLE III

WEIGHT LOSS IN 95-98% SULFURIC ACID AT VARIOUS TEMPERATURES, MPY

| TEMPERATURE | C | D | E | F | G | H | I |
|---|---|---|---|---|---|---|---|
| 80° | 0.6 | 0.4 | 0.6 | 1.4 | 3.6 | 2.2 | 2.4 |
| 90° | 1.5 | 0.8 | 0.7 | 3.2 | 5.8 | 2.8 | 3.1 |
| 100° | 2.5 | 3.1 | 3.3 | 4.6 | 7.9 | 3.7 | 4.6 |
| 120° | 17 | 19 | 5.9 | 7.2 | 11 | 6.7 | 7.9 |
| 140° | 20 | 32 | 11 | 12 | 13 | 10 | 11 |
| 160° | 17 | 19 | 8.5 | 8.3 | 9.2 | 7.4 | 8.6 |
| 180° | 11 | 14 | 8.8 | 9.1 | 11 | 8.3 | 10 |
| 200° | 12 | 16 | 9.6 | 13 | 14 | 10 | 12 |

These tests demonstrate that alloys of the invention are suitable for handling of hot concentrated sulfuric acid to at least 200° C.

EXAMPLE 4

Samples from the experimental heats of Example 1 were measured for hardness in the as cast condition and also after two cycles of aging for four hours at 1400° F. followed by rapid air cooling. The results of these hardness tests are set forth in Table IV.

TABLE IV

| BRINELL HARDNESS NUMBERS IN AS CAST AND HEAT TREATED CONDITION | | |
|---|---|---|
| ALLOY | AS CAST | HEAT TREATED |
| A | 243 | 302 |
| B | 275 | 354 |
| C | 240 | 300 |
| D | 260 | 325 |
| E | 233 | 290 |
| F | 245 | 275 |
| G | 254 | 315 |
| H | 218 | 266 |
| I | 208 | 262 |

Test data for prior art alloys in abrasive and corrosive wet process phosphoric acid slurries indicate that the alloys of the invention would have substantially improved service life, on the order of ten or more times the service life of prior art alloys, under such conditions. Such improvements in service life are expected even in instances in which the higher carbon alloys of the invention are not suitable due either to casting mass, design or a need for greater casting toughness in service. In view of the above, it will be seen that the several objects of the invention are achieved.

Although specific examples of the present invention are provided herein, it is not intended that they are exhaustive or limiting of the invention. These illustrations and explanations are intended to acquaint others skilled in the art with the invention, its principles, and is practical application, so that they may adapt and apply the invention in its numerous forms, as may be best suited to the requirements of a particular use.

What is claimed is:

1. An alloy consisting of the following components, by weight:

| | |
|---|---|
| CHROMIUM | 27–42% |
| NICKEL + COBALT | 11–40% |
| SILICON | 3–4.5% |
| COPPER | 1–4% |
| CARBON | 0.7–2% |
| MANGANESE | 0.3–3% |
| MOLYBDENUM | UP TO 4.5% |

-continued

| | |
|---|---|
| IRON | ESSENTIALLY THE BALANCE. |

2. The alloy of claim 1 consisting of up to about 2% W.

3. The alloy of claim 1 consisting of up to about 1% Nb.

4. The alloy of claim 1 wherein the chromium index (CI) as determined by the equation:

$$CI=[Cr]-6.08[C]$$

is not less than 25.

5. The alloy of claim 1 wherein which contains at least about 0.33% Mo and at least about 3.5% Si.

6. The alloy of claim 5 wherein the chromium index (CI) as determined by the equation:

$$CI=[Cr]-6.08[C]$$

is at least about 27.

7. An alloy consisting of the following components, by weight:

| | |
|---|---|
| CHROMIUM | 27–34% |
| NICKEL + COBALT | 13–31% |
| SILICON | 3.2–4.5% |
| COPPER | 2.5–4% |
| CARBON | 0.7–1.6% |
| MANGANESE | 0.5–1.5% |
| MOLYBDENUM | 1–4% |
| COBALT | UP TO ABOUT 1% |
| IRON | ESSENTIALLY THE BALANCE. |

8. The alloy of claim 7 consisting of up to about 2% W.

9. The alloy of claim 7 consisting of up to about 1% Nb.

10. The alloy of claim 7 wherein the chromium index (CI) as determined by the equation:

$$CI=[Cr]-6.08[C]$$

is not less than 25.

11. The alloy of claim 7 which contains at least about 0.33% Mo and at least about 3.5% Si.

12. The alloy of claim 11 wherein the chromium index (CI) as determined by the equation:

$$CI=[Cr]-6.08[C]$$

is at least about 27.

* * * * *

UNITED STATES PATENT AND TRADEMARK OFFICE

CERTIFICATE OF CORRECTION

PATENT NO. : 5,320,801

DATED : June 14, 1994

INVENTOR(S) : John H. Culling

It is certified that error appears in the above-identified patent and that said Letters Patent is hereby corrected as shown below:

In claim 1 at column 7, line 53, ---COBALT UP TO ABOUT 1%--- should be entered into the table on the line after immediately following "MOLYBDENUM."

Signed and Sealed this

Eighteenth Day of October, 1994

Bruce Lehman

*Attest:*

BRUCE LEHMAN

*Attesting Officer*

*Commissioner of Patents and Trademarks*